US005211472A

United States Patent [19]

Friederichs et al.

[11] Patent Number: 5,211,472

[45] Date of Patent: May 18, 1993

[54] ELECTRIC LAMP AND DISMANTLING TOOL FOR SAME

[75] Inventors: Winand H. A. M. Friederichs; Nicasius Van Gennip, both of Eindhoven, Netherlands

[73] Assignee: U.S. Philips Corporation, New York, N.Y.

[21] Appl. No.: 818,005

[22] Filed: Jan. 8, 1992

[30] Foreign Application Priority Data

Jan. 25, 1991 [NL] Netherlands ..... 9100123

[51] Int. Cl.[5] ..... H01J 61/00

[52] U.S. Cl. ..... 362/226; 362/457; 313/318

[58] Field of Search ..... 362/226, 457, 263; 313/318; 220/2.1 R, 281, 284

[56] References Cited

U.S. PATENT DOCUMENTS 4,645,967 2/1987 Bouman et al. ..... 220/2.1 R
4,795,056 1/1989 Meyers ..... 220/281
4,991,730 2/1991 Pehr ..... 220/284
5,006,752 4/1991 Egginc et al. ..... 313/161
5,130,912 7/1992 Friederichs et al. ..... 362/263

FOREIGN PATENT DOCUMENTS 0384520 8/1990 Netherlands .

*Primary Examiner*—Ira S. Lazarus
*Assistant Examiner*—L. Heyman
*Attorney, Agent, or Firm*—Paul R. Miller

[57] ABSTRACT

The electric lamp has a lamp vessel (1), which is secured to a cylindrical collar (20). A mounting member (40) is rotatably coupled to the collar (20), in that an end portion (41) thereof which is provided with a groove (42) projects into the collar (20) and in that the collar has hooks (21) gripping into the groove (42). The groove (42) has widened and deepened portions (42') extending to outside the collar (20), giving a special tool access to the hooks (21) to disengage them from the groove (42).

20 Claims, 3 Drawing Sheets

ELECTRIC LAMP AND DISMANTLING TOOL FOR SAME

CROSS REFERENCE TO RELATED APPLICATIONS

The present application is related to U.S. application Ser. No. 818,003, and to U.S. application Ser. No. 818,195, both of which were filed simultaneously herewith.

The invention relates to an electric lamp comprising a lamp vessel which is sealed in a vacuumtight manner and comprises an end portion, a light source in the lamp vessel, a cylindrical collar at the end portion, a mounting member for fastening the lamp to a support, hooks keeping the collar coupled to the mounting member.

The invention also relates to a tool for disengaging the mounting member from the collar.

BACKGROUND OF THE INVENTION

Such an electric lamp is known from European Patent No. EP-0 384 520.

The mounting member in the known lamp has hooks which grip around the collar at the lamp vessel in order to retain it. The lamp vessel can be taken from the mounting member in that the hooks are pressed from their seats. It can be disadvantageous if this is done by a non-expert.

The known lamp is an electrodeless low-pressure discharge lamp which is operated on a high-frequency voltage source. The lamp vessel has a coating of fluorescent powder and a cavity in the end portion into which an electric coil projects, which coil is supported by the mounting member.

A tension of several hundreds of volts is across the coil during lamp ignition. The coil generates a high electromagnetic field strength during ignition and operation. Removal of the lamp vessel while the coil is energized can be dangerous and harmful. Serious radio interference may occur and the supply of the lamp may become defective owing to the removal of the load.

Although the lamp vessel must not be removed by a non-expert, it is nevertheless desirable for the lamp vessel to be exchangeable, for example, in order to replace a defective, for example, a damaged lamp vessel which has become leaky, or for mounting a lamp vessel having a fluorescent powder which generates light of a different colour.

SUMMARY OF THE INVENTION

The invention has for its object to provide a lamp of the kind described in the opening paragraph which is of a simple construction and which renders possible a quick assembly of the lamp vessel with the mounting member without the use of tools, while the lamp vessel can nevertheless be easily removed by means of a special tool.

According to the invention, this object is achieved in that the mounting member has an end portion which projects rotatably into the collar, in that the collar has hooks at an inner surface thereof which grip into a groove in an outer surface of the mounting member, and in that there is clearance between the inner surface of the collar and the outer surface of the mounting member between the hooks.

In contrast to the known lamp, the hooks in the lamp according to the invention lie inside the collar and grip into a groove in the mounting member which projects into the collar. Lamp assembly is easy, the mounting member is simply snapped into the collar, but dismantling is not possible without special measures, since the hooks are hidden. However, a tool may be introduced into the groove next to the hooks, onto which tool the hooks can be turned through rotation of the collar. The cooperation between the hooks and the mounting member is thus undone and the lamp vessel with the collar can be removed from the mounting member.

It is favourable if a depth stop for the mounting member is present. It can be achieved by this that the collar and the mounting member are movable in the insertion direction of said member in the coupled state. The depth stop may be formed by one or several nubs on the mounting member but, in a favourable embodiment, by one or several nubs in the collar.

In a favourable embodiment, the mounting member has a circumferential groove into which the hooks grip. It will then be quickly clear to the user of the lamp that rotation of the lamp vessel will not lead to disengaging thereof. It is then prevented that tangential forces are exerted on the coupling during rotation. This would indeed be the case if the hooks each gripped, for example, into their own, non-circumferential groove. In addition, it is immaterial in the case of a circumferential groove in which relative rotational position the mounting member is mounted in the collar.

The hooks may be distributed along the circumference of the collar. However, an embodiment is attractive in which one or several hooks lie in a first quadrant of the inner surface of the collar, while the other hooks lie in the opposing third quadrant. This renders the dismantling tool very simple. The tool may be inserted in the second and the fourth quadrant and held in position relative to the mounting member, upon which the hooks are moved onto the tool through rotation of the collar.

The hooks may grip into a groove which is just wide enough for the hooks, or into a much wider groove, for example, a groove having the width of the dimension of the mounting member in its direction of insertion.

It is advantageous, however, if the groove widens in a first and in the opposing third quadrant of the outer surface of the mounting member. The tool may then be so dimensioned that it can only be accommodated in the wide portion of the groove. When the collar is rotated so as to have the hooks move onto the tool, the tool then meets with a tangential stop which prevents it being rotated by the hooks.

It is favourable if the groove widens in the first and third quadrants to outside the collar, so that the tool may be easily brought into the correct position.

In a special embodiment, the collar has a thinned wall portion between the hooks. This embodiment has the advantage that the collar and the mounting member may be easily snapped together and separated again. In fact, the collar must be pressed outwardly at the area of the hooks during these operations. The collar must become unround. Thanks to the thinned wall portions, the wall can more easily be elastically deformed during this, while also more space is available for this deformation, and tangential elongation in the wall can remain limited or be prevented all together.

A favourable embodiment of a tool for disengaging the lamp vessel has a first and second cylindrically bent strip, which strips are movably interconnected in order to form a first and a third quadrant of a cylinder when brought into mutual opposition. It is advantageous if the opposing ends of the strip are bevelled at their outer surfaces. The result of this is that the hooks easily climb up against these outer surfaces.

BRIEF DESCRIPTION OF THE DRAWINGS

This and other aspects of the electric lamp according to the invention and the associated tool are shown in the drawings, in which.

DESCRIPTION OF THE PREFERRED EMBODIMENTS

Figure 1:
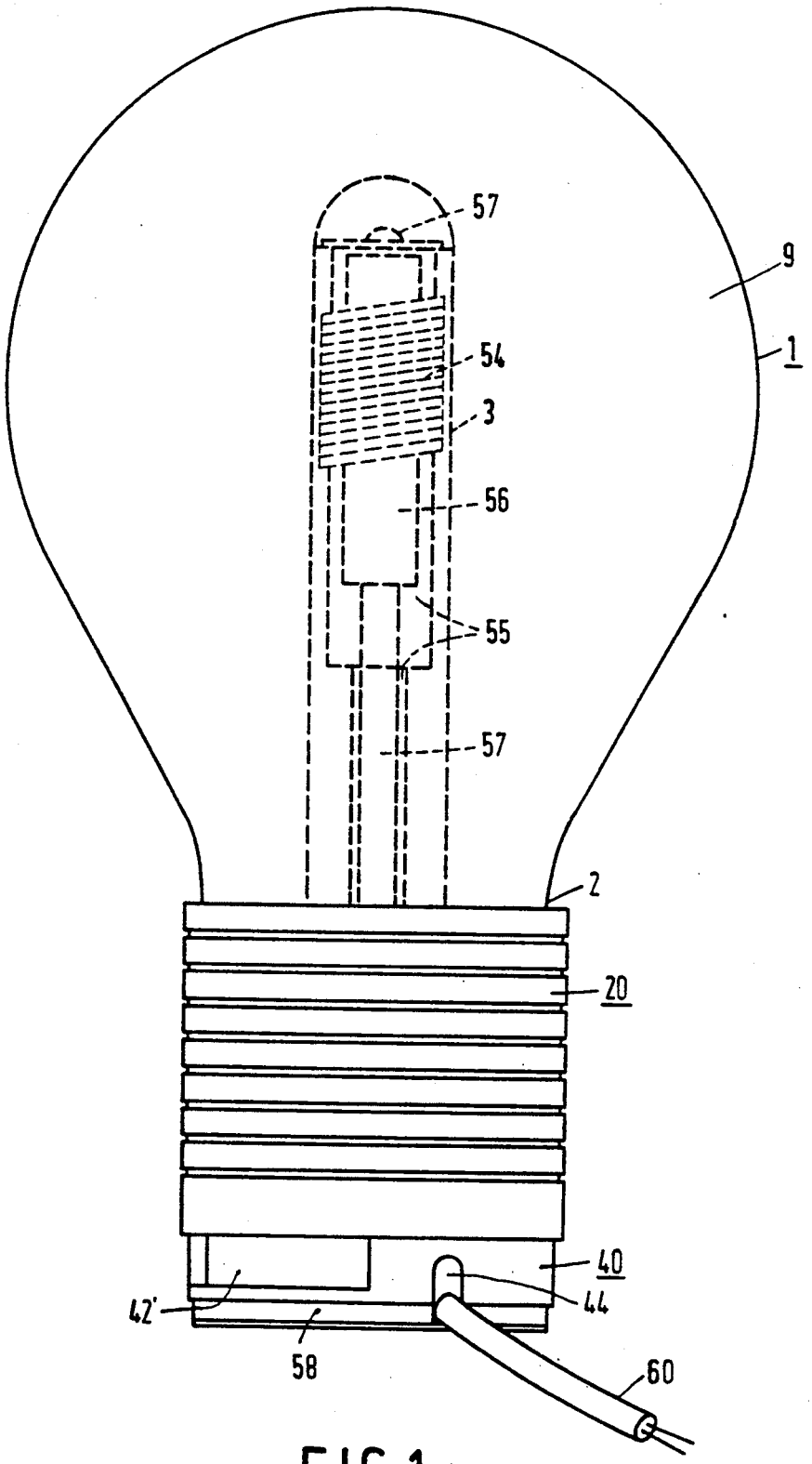
FIG. 1 shows an embodiment of the lamp in side elevation.

In FIG. 1, the electric lamp has a lamp vessel 1 made of, for example, lime glass, sealed in a vacuumtight manner and having an end portion 2 made of, for example, lead glass. The lamp vessel in the drawing has a cavity 3 in the end portion in which an electric coil 54 is present around a sleeve 55 of synthetic material. In this sleeve there is a core 56 of soft magnetic material in which a tube 57 is arranged which contains liquid and which is fastened to a flange 58.

A light source 9 is arranged in the lamp vessel 1. The light source comprises ionizable metal vapour and rare gas, and a coating of fluorescent powder. The lamp is supplied at a high frequency via a cable 60 which is connected to the electric coil 54.

The coil 54 and the core 56 in the drawn lamp generate an electromagnetic field in the metal vapour and the rare gas which results in a discharge. The UV radiation formed thereby is converted into visible radiation by the fluorescent powder. Heat generated in the lamp is discharged through the tube 57 and the liquid therein, for example water, to the flange 58 and from there to the surroundings.

It is obvious that the nature of the light source is immaterial to the principle of the invention. In a different embodiment, the light source may, for example, be an incandescent body, or a rare gas with metal halides, for example, in a lamp vessel with a discharge path between electrodes.

A cylindrical collar 20, for example made of synthetic material, for example thermoplastic material, such as, for example, polyether imide, polyether sulphon, or polyether sulphide, is fixed to the end portion 2, for example, with glue or cement, or, for example, with a silicone compound.

The lamp further comprises a mounting member 40 for fastening the lamp to a support, hooks 21 keeping the collar 20 coupled to the mounting member 40.

The mounting member 40 has an end portion 41 (FIG. 3) which projects into the collar 20 with rotation possibility. The collar 20 has at an inner surface 22 (FIG. 2, 4) thereof hooks 21 which grip into groove 42 in an outer surface 43 of the mounting member (FIG. 3).

Clearance 23 is present between the inner surface 22 of the collar 20 and the outer surface 43 of the mounting member 40 between hooks 21.

Figure 2:
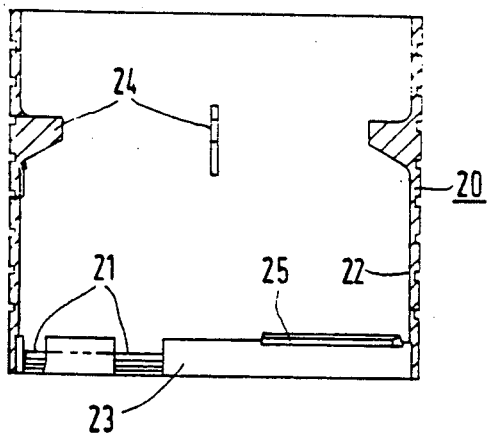
FIG. 2 shows the collar of FIG. 1 in longitudinal section.

The collar 20 has, as is apparent from FIG. 2, nubs 24 which form a seat for the lamp vessel 1. A rim 25 in the collar 20 forms a depth stop for the mounting member 40.

Figure 3:
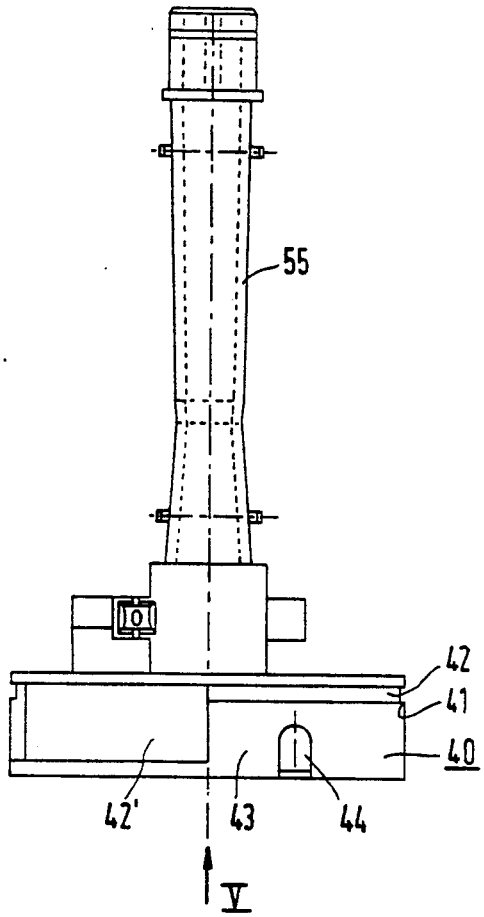
FIG. 3 shows the mounting member of FIG. 1 in side elevation.

As FIG. 3 shows, the mounting member 40 has a circumferential groove 42 which has a widened, but also deepened portion 42'.

An opening 44 renders it possible for a supply cable 60 for the coil 54 (FIG. 1) to issue laterally, but also longitudinally.

Figure 4:
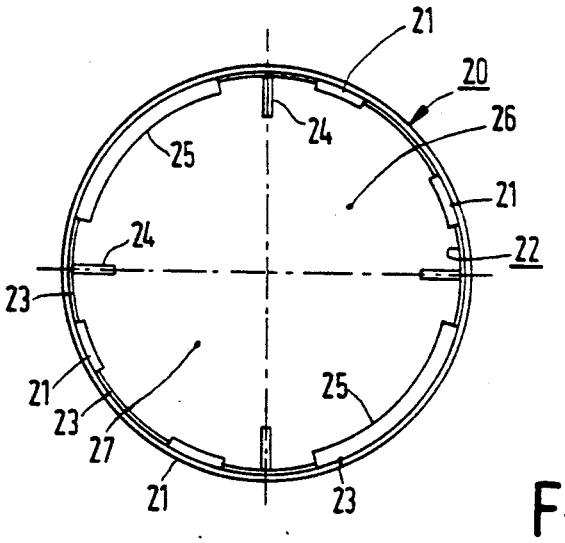
FIG. 4 shows the collar taken on IV in FIG. 2.

The hooks 21, as FIG. 4 shows, are present in a first quadrant 26 of the inner surface 22 of the collar 20, and in the opposing third quadrant 27.

Figure 5:
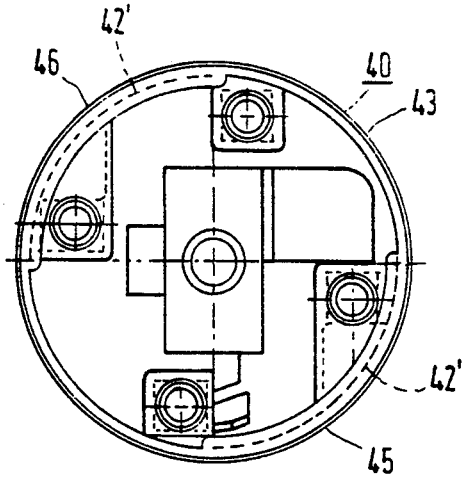
FIG. 5 shows the mounting member taken on V in FIG. 3.

According to FIG. 5, the mounting member has a groove 42 which has a deepened and widened portion 42' in a first quadrant 45 and in a third quadrant 46 of the outer surface 43. The widened and deepened portions 42' extend to outside the collar 20 (FIG. 1).

FIGS. 2 and 4 show that the collar 20 has a thinned wall portion 23 between the hooks 21.

Figure 6:
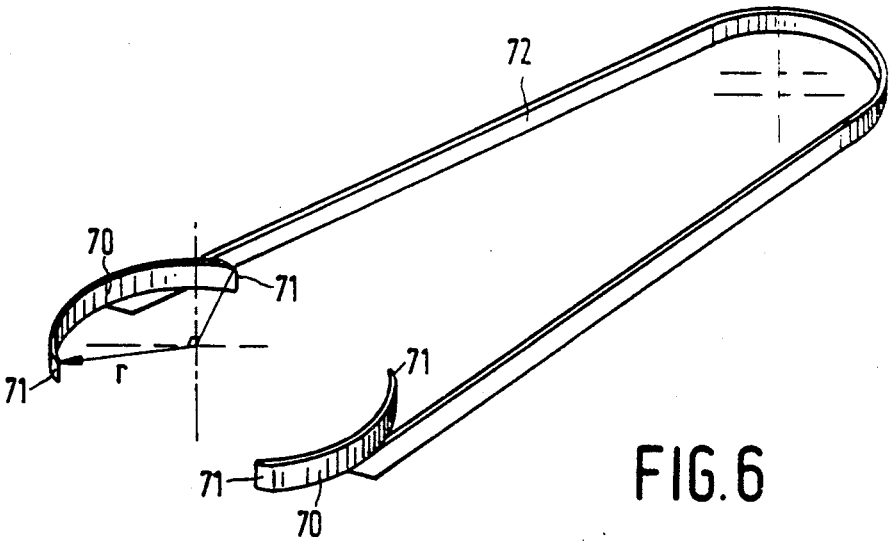
FIG. 6 shows an embodiment of the tool in perspective view.

In FIG. 6, the tool comprises a first and a second cylindrical bent strip 70, which strips are interconnected by an elastic bracket 72 in order to form a first 73 and a third 74 quadrant of a cylinder when brought into mutual opposition. The opposing end portions 71 of the strips are bevelled at their outer surfaces.

When the lamp vessel 1 with the collar 20 is removed from the mounting member 40, the strips 70 are introduced into the widened portions 42' of the groove 42 and moved towards the lamp vessel 1. When the hooks 21 (FIG. 4) are in the portions 42', the collar is rotated, at most through 90°, until the strips 70 can be moved further towards the lamp vessel. After that, the collar is rotated through approximately 90° in order to move the hooks 21 onto the strips 70, so that they are pressed from the groove 42 and the lamp vessel 1 with the collar 20 can be disengaged from the mounting member 20.

We claim:

1. An electric lamp comprising
   - a lamp vessel (1) which is sealed in a vacuumtight manner and comprises an end portion (2),
   - a light source (9) in the lamp vessel,
   - a cylindrical collar (20) at the end portion,
   - a mounting member (40) for fastening the lamp to a support, a plurality of hooks (21) keeping the collar (20) coupled to the mounting member (40), characterized in that
     - the mounting member (40) has an end portion (41) which projects rotatably into the collar (20),
     - the collar has the hooks (21) at an inner surface (22) thereof which grip into a groove (42) in an outer surface (43) of the mounting member (40), and
     - there is clearance between the inner surface (22) of the collar (20) and the outer surface (43) of the mounting member (40) between the hooks (21).

2. An electric lamp as claimed in claim 1, characterized in that the groove is circumferential and the hooks grip into said circumferential groove.

3. An electric lamp as claimed in claim 2, characterized in that the hooks lie in a first quadrant and in an opposing third quadrant of the inner surface of the collar.

4. An electric lamp as claimed in claim 3, characterized in that the groove has a widened portion in a first and a third quadrant of the outer surface of the mounting member.

5. An electric lamp as claimed in claim 4, characterized in that the widened portion of said groove extends to outside the collar.

6. An electric lamp as claimed in claim 5, characterized in that the widened portion is also deepened.

7. An electric lamp as claimed in claim 6, characterized in that the collar has a thinned wall portion between the hooks.

8. An electric lamp as claimed in claim 4, characterized in that the widened portion is also deepened.

9. An electric lamp as claimed in claim 1, characterized in that a depth stop (25) for the mounting member (40) is present.

10. An electric lamp as claimed in claim 9, characterized in that the groove (42) is circumferential and the hooks (21) grip into said circumferential groove.

11. An electric lamp as claimed in claim 10, characterized in that the hooks (21) lie in a first quadrant (26) and in an opposing third quadrant (27) of the inner surface (22) of the collar (20).

12. An electric lamp as claimed in claim 11, characterized in that the groove (42) has a widened portion (42') in a first (45) and a third quadrant (46) of the outer surface (43) of the mounting member.

13. An electric lamp as claimed in claim 12, characterized in that the widened portion (42') of said groove extends to outside the collar (20).

14. An electric lamp as claimed in claim 13, characterized in that the widened portion (42') is also deepened.

15. An electric lamp as claimed in claim 14, characterized in that the collar (20) has a thinned wall portion (23) between the hooks (21).

16. An electric lamp as claimed in claim 11 wherein a tool may be used to disengage the lamp vessel from the lamp, said tool, characterized by a first and a second cylindrically bent strip (70), which strips are movably interconnected in order to form a first (73) and a third (74) quadrant of a cylinder when brought into mutual opposition.

17. An electric lamp as claimed in claim 16 wherein said tool for disengaging the lamp vessel from the lamp is further characterized in that the opposing end portions (71) of the strips (70) are bevelled at their outer surfaces.

18. An electric lamp as claimed in claim 12, characterized in that the widened portion is deepened.

19. An electric lamp as claimed in claim 18, characterized in that the collar has a thinned wall portion between the hooks.

20. An electric lamp as claimed in claim 1, characterized in that the collar has a thinned wall portion between the hooks.

* * * * *